US010105976B2

(12) United States Patent
Yoshikawa

(10) Patent No.: US 10,105,976 B2
(45) Date of Patent: Oct. 23, 2018

(54) DOT RECORDING APPARATUS, PRODUCTION METHOD OF DOT RECORDED MATTER, AND COMPUTER PROGRAM

(71) Applicant: SEIKO EPSON CORPORATION, Tokyo (JP)

(72) Inventor: Eishin Yoshikawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/288,117

(22) Filed: Oct. 7, 2016

(65) Prior Publication Data

US 2017/0106685 A1 Apr. 20, 2017

(30) Foreign Application Priority Data

Oct. 16, 2015 (JP) ..... 2015-204361

(51) Int. Cl.
*B41J 25/00* (2006.01)
*B41J 2/21* (2006.01)

(52) U.S. Cl.
CPC ..... *B41J 25/006* (2013.01); *B41J 2/2121* (2013.01); *B41J 2/2132* (2013.01)

(58) Field of Classification Search
CPC ..... B41J 29/393; B41J 25/001; B41J 25/006; B41J 2/2121; B41J 2/2132; B41J 2/2135; B41J 2/21; B41J 2/04593; B41J 2/95; B41J 2/2052; B41J 2/054; B41J 2/2125; B41J 2/5054; B41J 2/056
See application file for complete search history.

(56) References Cited

U.S. PATENT DOCUMENTS 5,633,663 A 5/1997 Matsubara et al.
6,312,096 B1 * 11/2001 Koitabashi ..... B41J 2/04518 347/40
2002/0001004 A1 * 1/2002 Mantell ..... B41J 2/2125 347/15
2007/0211101 A1 * 9/2007 Yamanobe ..... B41J 2/04508 347/19
2007/0236745 A1 10/2007 Noguchi et al.
(Continued)

FOREIGN PATENT DOCUMENTS

EP 1998274 A1 12/2008
JP 06-022106 A 1/1994
(Continued)

OTHER PUBLICATIONS

The Extended European Search Report for the corresponding European Application No. 16193781.8 dated Mar. 27, 2017.

*Primary Examiner* — Patrick King

(57) ABSTRACT

A dot recording apparatus executes recording of dots that are included in a common region using a plurality of main scan passes, and, in each main scan pass, executes a first recording, which records a supercell, which is a mass of dot groups in which at least a portion of a boundary line is not parallel to either the main scanning direction or the sub-scanning direction, and a second recording, which records dots so as to be smaller than the supercell, which is recorded in the first recording, in positions in the main scanning direction that differ from positions in the main scanning direction, which the first recording executed.

10 Claims, 12 Drawing Sheets

(56) References Cited

U.S. PATENT DOCUMENTS

| | | | | |
|---|---|---|---|---|
| 2008/0079960 | A1* | 4/2008 | Yamazaki | B41J 29/393 358/1.8 |
| 2008/0123117 | A1* | 5/2008 | Kimura | B41J 2/04508 358/1.8 |
| 2011/0181897 | A1 | 7/2011 | Noguchi et al. | |
| 2011/0261099 | A1 | 10/2011 | Miyashita et al. | |
| 2012/0262736 | A1 | 10/2012 | Noguchi et al. | |
| 2014/0028748 | A1* | 1/2014 | Hudd | B41J 2/15 347/12 |
| 2015/0015626 | A1 | 1/2015 | Kayahara et al. | |
| 2015/0091958 | A1* | 4/2015 | Terada | B41J 25/003 347/9 |
| 2015/0328901 | A1* | 11/2015 | Wakui | H04N 1/405 347/15 |
| 2016/0286770 | A1* | 10/2016 | Yokoyama | B41J 2/2132 |

FOREIGN PATENT DOCUMENTS

| | | | |
|---|---|---|---|
| JP | 2007-306550 | A | 11/2007 |
| JP | 2015-016671 | A | 1/2015 |

* cited by examiner

DOT RECORDING APPARATUS, PRODUCTION METHOD OF DOT RECORDED MATTER, AND COMPUTER PROGRAM

BACKGROUND

1. Technical Field

The present invention relates to the recording of dots.

2. Related Art

A technique that, in a case of executing character printing by causing a plurality of recording heads, which discharge ink of different colors, to reciprocate, with respect to a recording material, and executing a main scan during an outward motion and during a return motion, records in a region over which character printing with a single main scan is possible with m×n dot groups set as a unit by executing a main scan a plurality of times using a plurality of thinning patterns, which are arranged in a manner in which the dot groups are not adjacent to one another, and which are in complementary arrangement relationships, is known (JP-A-6-22106).

In the above-mentioned technique, individual dot groups are formed in a rectangular shape. A boundary line of these rectangles is configured by an edge that is parallel to a main scanning direction, and an edge that is parallel to a sub-scanning direction. Accordingly, a long boundary line that extends in the main scanning direction, and a long boundary line that extends in the sub-scanning direction are formed through aggregation of the boundary lines of adjacent dot groups.

A technique that forms dot groups so that boundary lines of dot groups are not parallel to either the main scanning direction or the sub-scanning direction, is known as another technique (JP-A-2015-16671). In this technique, dot groups are classified as dot groups that belong to a first region (hereinafter, referred to as first dot groups) and dot groups that belong to a second region (hereinafter, referred to as second dot groups), and dot groups that belong to each region are formed using separate main scan passes. According to this technique, it is difficult for banding to stand out.

In cases of techniques that use dot groups such as JP-A-6-22106 and JP-A-2015-16671, while it is easier to suppress color spotting (color variation), it is easy for image quality to deteriorate as a result of the influence of cockling of a recording medium. It is easy for the relative positional relationships of the first dot groups and the second dot groups of JP-A-2015-16671 to become shifted at locations in which there is a large amount of cockling. When this shifting occurs, dots overlap, dots are not formed in locations in which they should be formed, and the like. Hereinafter, deteriorations in image quality due to these phenomena will be referred to as boundary spotting.

SUMMARY

An advantage of some aspects of the invention is to suppress deteriorations in image quality due to cockling in a technique that uses dot groups.

The invention is realized as the following aspect.

According to an aspect of the invention, there is provided a dot recording apparatus including a main scan driving mechanism that executes a main scan pass, which records dots on a medium while relatively moving a head having a plurality of nozzles, and the medium in a main scanning direction, and a sub-scan driving mechanism that executes a sub-scanning, which relatively moves the medium and the head in a sub-scanning direction, which intersects the main scanning direction, in which recording of dots is executed in a common region of the medium using a plurality of main scan passes, and, in the respective a plurality of main scan passes, a first recording, which records a supercell, which is a mass of dot groups in which at least a portion of a boundary line is not parallel to either the main scanning direction or the sub-scanning direction, and a second recording, which records the dots so as to be smaller than the supercell, which is recorded in the first recording, in positions in the main scanning direction that differ from positions in the main scanning direction, which the first recording executed, are executed. According to the aspect, it is easier to suppress deteriorations in image quality due to cockling. If the second recording is executed in a position in the main scanning direction at which it is easy for cockling to occur, either supercells are not formed in the position, or supercells that are smaller than the supercells in the first recording, are formed. The smaller a supercell is, the more difficult it is for the supercell to be subjected to the influence of cockling, and therefore, boundary spotting is suppressed. Accordingly, if the second recording is executed in a position in the main scanning direction at which it is easy for cockling to occur, boundary spotting is suppressed, and therefore, deteriorations in image quality are suppressed.

In the dot recording apparatus, recording may be performed so that the second recording is larger than the first recording in a case in which the head is positioned in a center in the main scanning direction. According to the aspect, deteriorations in image quality are suppressed in a central portion. Since it is easy for cockling to occur in a central portion of a medium, deteriorations in image quality are suppressed by making the second recording, in which it is easy to further suppress boundary spotting, larger.

In the dot recording apparatus, recording may be performed so that the first recording is larger than the second recording in a case in which the head is positioned at end portions in the main scanning direction. According to the aspect, deteriorations in image quality are suppressed at end portions. The reason for this is that it is easy for the first recording, in which it is easier to further suppress color spotting, to suppress deteriorations in image quality since it is difficult for cockling to occur at end portions of a medium.

In the dot recording apparatus, a ratio of the first recording and the second recording may be changed during the main scan passes. According to the aspect, in a single main scan pass, it is possible to use the first recording in locations in which it is easy for cockling to occur, and use the second recording in locations other than locations in which it is easy for cockling to occur.

In the dot recording apparatus, recording may be executed using a disposition in which dots are dispersed as the second recording. In this case, it is possible to suppress color spotting due to the second recording.

In the dot recording apparatus supercells that are smaller than the supercells, which are recorded in the first recording, may be recorded as the second recording. According to the aspect, it is possible to suppress boundary spotting due to the second recording.

In the dot recording apparatus, a plurality of the supercells may be recorded as the first recording, and the boundary lines of the plurality of supercells may have the same polygonal shape. In this case, it is possible to easily set the shapes of the supercells.

In the dot recording apparatus, the supercells may include parallel boundary lines, which are boundary lines that are parallel to either the main scanning direction or the sub-scanning direction, and the parallel boundary line that is included in a given supercell may be formed in a position that is separated from the parallel boundary line that is included in another supercell. According to the aspect, since parallel boundary lines are not formed continuously even if parallel boundary lines are included, it is difficult to visually recognize boundary spotting, and therefore, deteriorations in image quality are suppressed.

The invention can be realized using various forms other than those above. For example, the invention can be realized as a production method of recorded matter, a computer program for realizing such a method, a non-temporary storage medium on which such a computer program is stored, or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Figure 1:
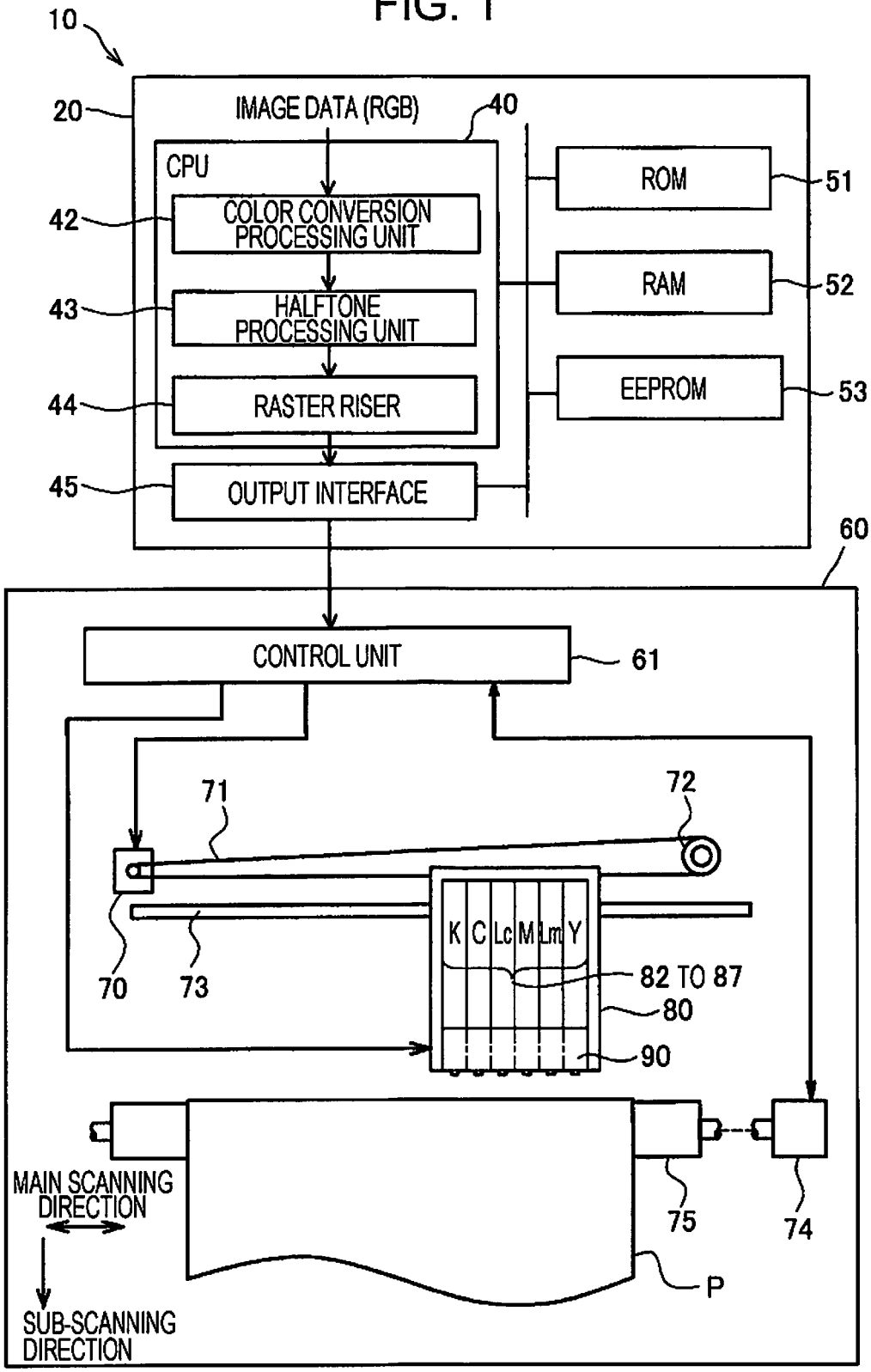
FIG. 1 is a configuration diagram of a dot recording apparatus.

FIG. 1 shows a configuration of a dot recording apparatus 10. More specifically, the dot recording apparatus 10 is a printing apparatus. The dot recording apparatus 10 is provided with an image processing unit 20, and a dot recording unit 60. The image processing unit 20 creates printing data for the dot recording unit 60 from image data (for example, RGB image data).

The image processing unit 20 is provided with a CPU 40, a ROM 51, a RAM 52, an EEPROM 53, and an output interface 45. The image processing unit 20 realizes functions of a color conversion process section 42, a halftone process section 43, and a raster riser 44. The image processing unit 20 is realized as a result of the execution of these functions by a computer program. The computer program is stored in the ROM 51.

The color conversion process section 42 converts multi-gradation RGB data of an image into ink amount data. The ink amount data shows respective ink amounts of a plurality of colors of ink. The halftone process section 43 creates dot data, which shows the presence or absence of dot formation for each pixel, as a result of executing a halftone process on the ink amount data.

The raster riser 44 rearranges the dot data created in the halftone process into dot data that is used in a main scan by the dot recording unit 60. Hereinafter, dot data for each main scan, which is created by the raster riser 44, will be referred to as "raster data".

The dot recording unit 60 is a serial type ink jet recording apparatus. The dot recording unit 60 is provided with a control unit 61, a carriage motor 70, a driving belt 71, a pulley 72, a sliding shaft 73, a paper feeding motor 74, a paper feeding roller 75, a carriage 80, ink cartridges 82 to 87, and a recording head 90.

The driving belt 71 is stretched between the carriage motor 70 and the pulley 72. The carriage 80 is attached to the driving belt 71. For example, the ink cartridges 82 to 87, which respectively accommodate cyan ink (C), magenta ink (M), yellow ink (Y), black ink (K), light cyan ink (Lc), and light magenta ink (Lm), are installed in the carriage 80. Nozzle rows, which corresponds to each of the colors of ink mentioned above, are formed in the recording head 90 in the lower portion of the carriage 80. When these ink cartridges 82 to 87 are mounted in the carriage 80 from above, it is possible to supply ink to the recording head 90 from each cartridge. The sliding shaft 73 is disposed parallel to the driving belt, and penetrates through the carriage 80.

When the carriage motor 70 drives the driving belt 71, the carriage 80 moves relatively along the sliding shaft 73 with respect to a recording medium P. This direction of movement will be referred to as a "main scanning direction". The carriage motor 70, the driving belt 71 and the sliding shaft 73 configure a main scan driving mechanism. The ink cartridges 82 to 87 and the recording head 90 also move in the main scanning direction along with the movement of the carriage 80 in the main scanning direction. Dot recording is executed on a recording medium P as a result of ink being ejected onto the recording medium P from nozzles (to be described later), which are mounted in the recording head 90, during movement in the main scanning direction. In this manner, movement of the recording head 90 in the main scanning direction and the ejection of ink will be referred to as a main scan, and a single main scan will be referred to as a "main scan pass".

The paper feeding roller 75 is connected to the paper feeding motor 74. During recording, a recording medium P is inserted onto the paper feeding roller 75. When the carriage 80 moves up to an end portion in the main scanning direction, the control unit 61 rotates the paper feeding motor 74. As a result of this, the paper feeding roller 75 rotates, and the recording medium P is moved with respect to the recording head 90. A movement direction of the recording medium P will be referred to as a "sub-scanning direction". The paper feeding motor 74 and the paper feeding roller 75 configure a sub-scan driving mechanism. The sub-scanning direction is a direction that is orthogonal to the main scanning direction.

Figure 2:
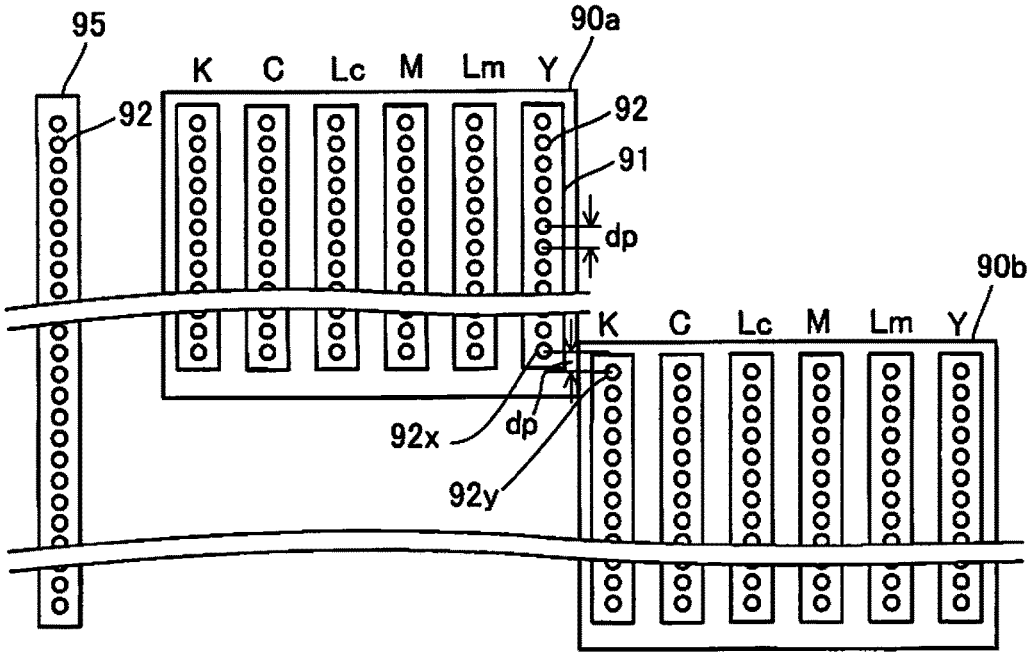
FIG. 2 is a view that shows nozzle rows of a recording head.

FIG. 2 shows an example of a configuration of nozzle rows of the recording head 90. In the present embodiment there are two recording heads 90. The two recording heads 90*a* and 90*b* are provided with a nozzle row 91 for each color. Each nozzle row 91 is provided with a plurality of nozzles 92, which are aligned in the sub-scanning direction at a constant nozzle pitch dp. A nozzle 92*x* of an end portion of a nozzle row 91 of the first recording head 90*a*, and the nozzles 92*y* of an end portion of a nozzle row 91 of the second recording head 90*b* are shifted in the sub-scanning direction by an amount that is equivalent to the same size as the nozzle pitch dp in a nozzle row 91. In this case, the nozzle rows of a single color of the two recording heads 90*a* and 90*b* are the same as a nozzle row 95 (illustrated on the left hand side in FIG. 2), which has twice the number of nozzles of the number of nozzles of a single color of a single recording head 90. In the following description, a method that executes dot recording of a single color will be described using the nozzle row 95. In the present embodiment, the nozzle pitch dp and a pixel pitch on the recording medium P are equivalent.

Figure 3:
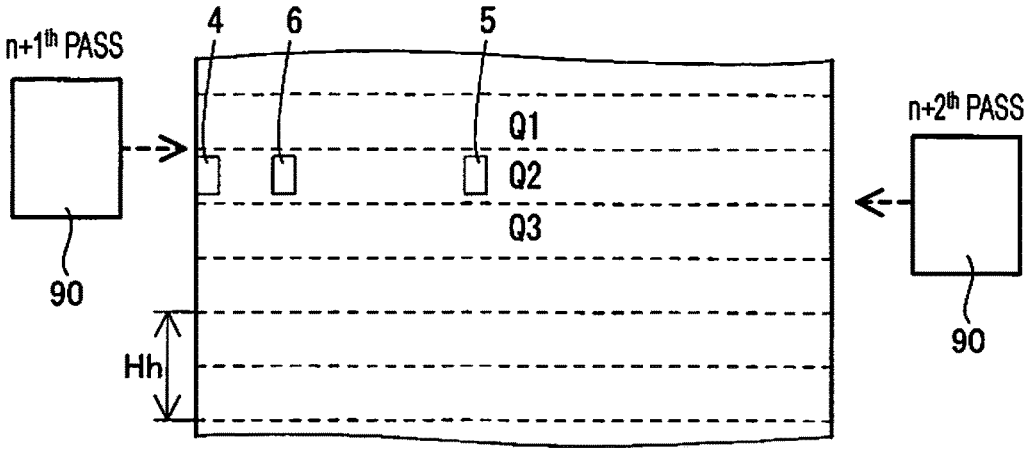
FIG. 3 is a view that shows a common region.

FIG. 3 is a view that shows a common region. The subsequent description uses a case of forming dots using a single color of ink (for example, cyan ink) as an example. In the present specification, the formation of dots, which are included in each common region, is completed using main scan passes of a plurality of times (twice in the present embodiment). The position of the nozzle row 95 is shifted in the sub-scanning direction by an amount that is equivalent to a distance, which corresponds to half a head height Hh, by an n (n is an integer of 0 or more)+$1^{th}$ pass (a first pass), and an n+$2^{th}$ pass (a second pass). The head height Hh refers to a distance that is represented by M×dp (M is a number of nozzles of the nozzle row 95, and dp is the nozzle pitch).

In an n+$1^{th}$ pass, dot recording is executed in a portion of a common region Q1 through which an upper half of the nozzles of the nozzle row 95 passes, and a portion of a common region Q2 through which a lower half of the nozzles of the nozzle row 95 passes. The above-mentioned portion of the common region Q1 refers to a portion of pixels among a plurality of pixels that configure the common region Q1. The same applies to the common region Q2 and a common region Q3, which will be described later.

In an n+$2^{th}$ pass, among pixels that configure the common region Q2 through which the upper half of the nozzles of the nozzle row 95 pass, dot recording is executed in pixel in which dots are not formed in the n+$1^{th}$ pass and a portion of a common region Q3 through which the lower half of the nozzles of the nozzle row 95 pass.

In the abovementioned manner, recording of 100% of the pixels is executed in the common region Q2 by an n+$1^{th}$ pass and an n+$2^{th}$ pass. Additionally, a case in which an image (a solid image), which forms dots in all of the pixels of the common region Q2, is formed, is assumed, but normally, dots are not formed in a portion of pixels. Whether or not a dot is formed in a pixel is decided by the dot data, which is created by the halftone process.

Figure 4:
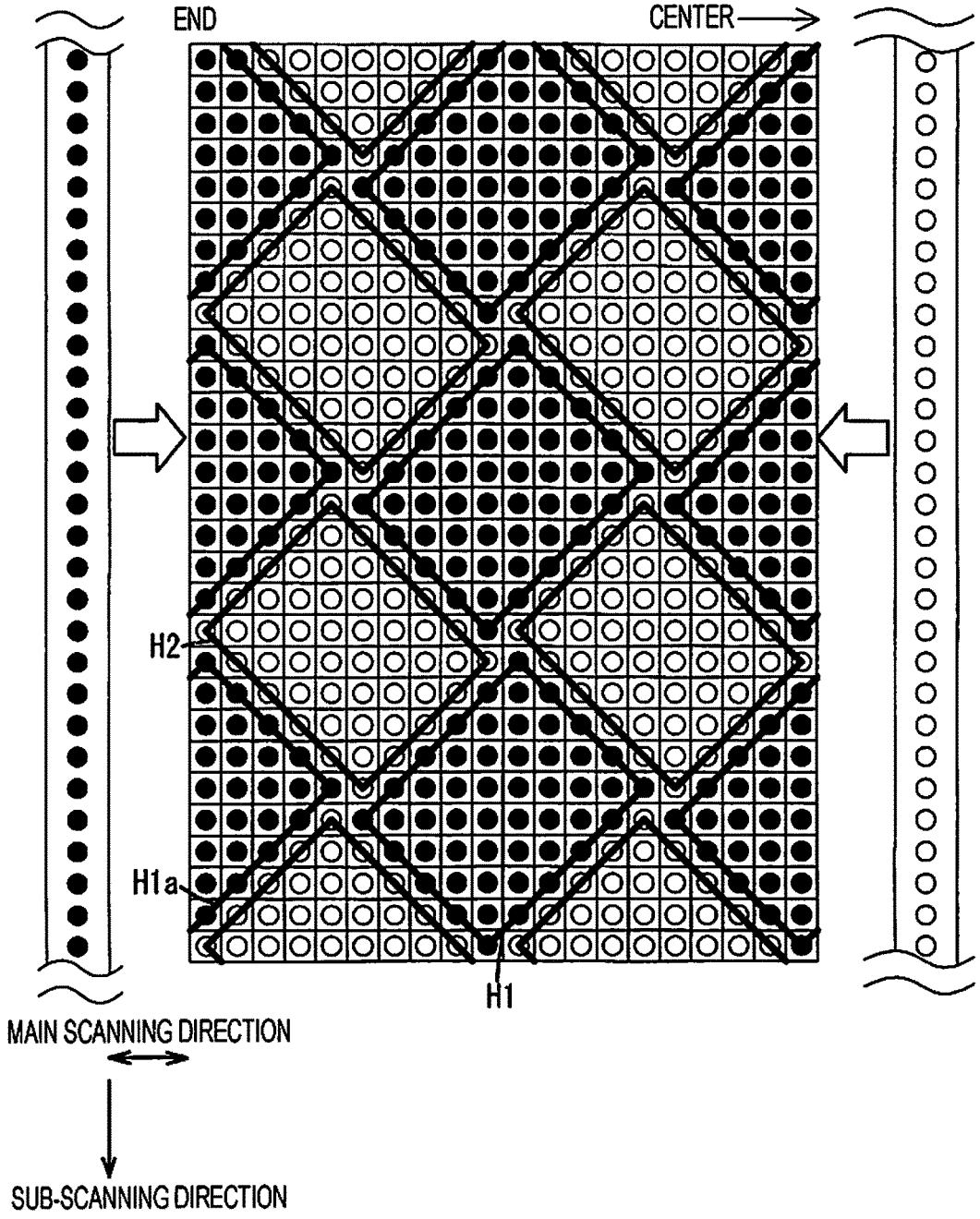
FIG. 4 is a view that shows dot formation in an end portion region.

FIG. 4 shows a state in which dots are formed in a region 4, which is shown in FIG. 3, by an n+$1^{th}$ pass and an n+$2^{th}$ pass. The region 4 is a region that is in the vicinity of an end in the main scanning direction. In FIG. 4, an individual cell number shows a region of a single pixel. Dots that are shown by black circles are dots (hereinafter, referred to as black dots) that are recorded in an n+$1^{th}$ pass. Dots that are shown by white circles are dots (hereinafter, referred to as white dots) that are recorded in an n+$2^{th}$ pass.

A plurality of black dots form a mass. More specifically, boundary lines of regions that are filled with which black dots, form an oblong shape. This oblong shape is formed by linking the centers of mutually adjacent black edge dots with a line segment. Black edge dots are black dots that are adjacent to white dots in at least either the main scanning direction or the sub-scanning direction.

A mass of black dots in the region 4 will be referred to as a supercell H1. In the present embodiment, a supercell refers to a mass of dot groups in which at least a portion of the boundary lines are not parallel to either the main scanning direction or the sub-scanning direction. In the case of a supercell H1, all of the edges are not parallel to either the main scanning direction of the sub-scanning direction. The dots that configure a supercell H1 are formed by a portion of the nozzle 92, which configurations a nozzle row 91.

All of the supercells H1 have the same shape. The lengths of single edges of a supercell H1 are (4√2) dp and (5√2) dp. The number of black dots that configure a supercell H1 is 50. All of the black dots in the region 4 belong to one of the supercells H1. However, in the supercells H1 that are positioned at ends in the main scanning direction, there are supercells H1 in which only a portion of the oblong shape is formed. This kind of supercell H1 will be specifically referred to as a supercell H1*a*.

A plurality of white dots form a mass. A mass of white dots in the region 4 will be referred to as a supercell H2. All of the supercells H2 have the same shape. The shape of the supercells H2 is equivalent to a shape in which a supercell H1 is rotated by 90°. Accordingly, the lengths of the edges and the number of white dots are the same as those of the supercells H1. All of the white dots in the region 4 belong to one of the supercells H2.

A recording method that uses the supercells H1 and H2 described above will be referred to as a first recording in the present embodiment.

Figure 5:
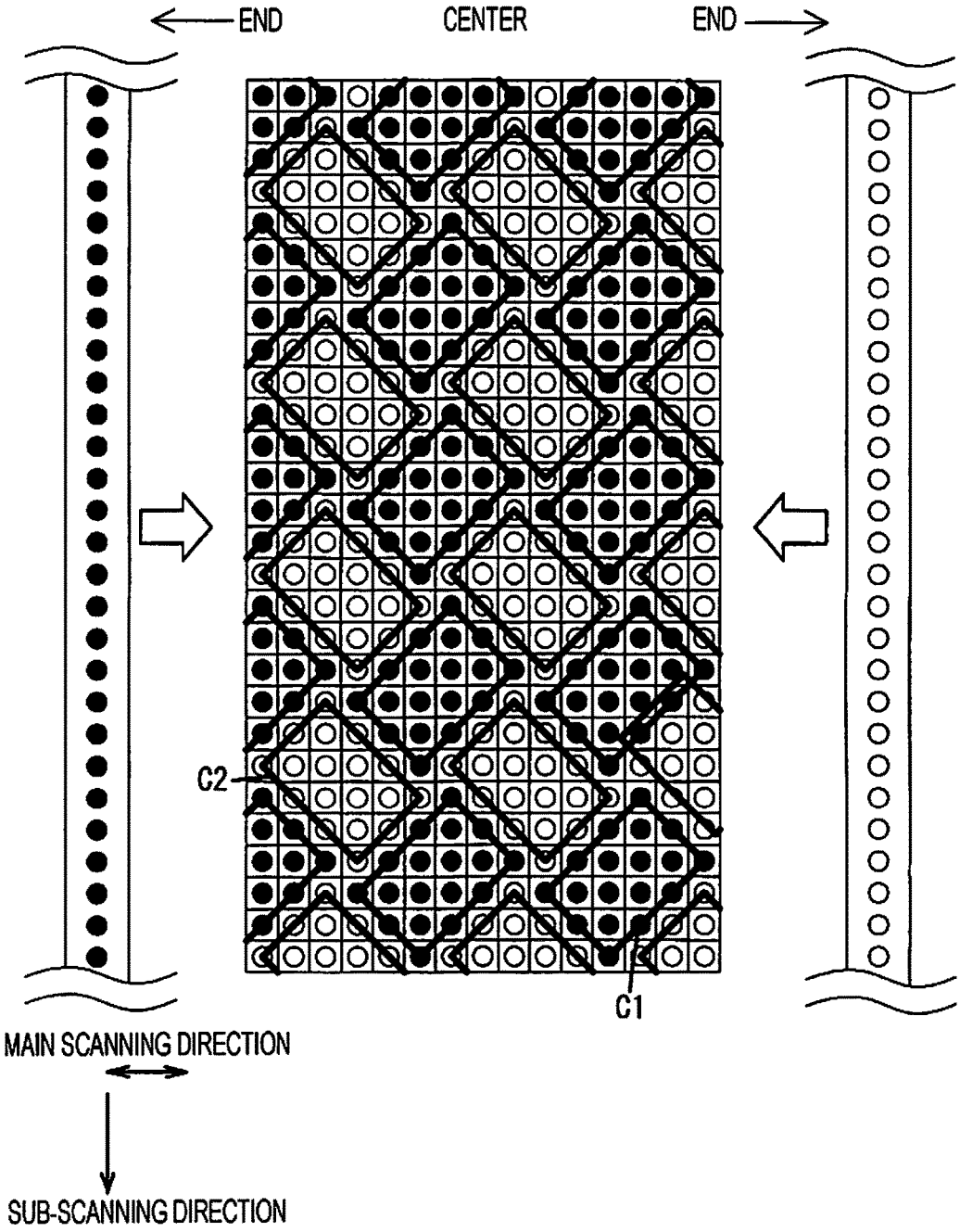
FIG. 5 is a view that shows dot formation in a central region.

FIG. 5 shows a state in which dots are formed in a region 5, which is shown in FIG. 3, by an n+$1^{th}$ pass and an n+$2^{th}$ pass. The region 5 is a region that is in the vicinity of the center in the main scanning direction.

In the same manner, as the region 4, a plurality of black dots and a plurality of white dots form oblong masses. A mass of a plurality of black dots in the region 5 will be referred to as a supercell C1, and a mass of a plurality of white dots will be referred to as a supercell C2.

Each edge of a supercell C1 is not parallel to either the main scanning direction of the sub-scanning direction. The lengths of single edges of a supercell C1 are (2√2) dp and (3√2) dp. The number of black dots that configure a supercell C1 is 18. All of the black dots in the region 5 belong to one of the supercells C1.

A plurality of white dots form a mass. The shape of the masses is equivalent to a shape in which a supercell C1 is rotated by 90°. All of the white dots in the region 5 belong to one of the supercells C2.

A recording method that uses the supercells C1 and C2 described above will be referred to as a second recording in the present embodiment. It is possible to treat the second recording as a recording method that records in a manner that is smaller than the supercells H1 and H2 in positions in the main scanning direction that differ from the positions in the main scanning direction that the first recording executes. In addition, it is possible to treat the second recording as a recording method that avoids the recording of supercells that are larger than the supercells H1 and H2 or of the same size in positions in the main scanning direction that differ from the positions in the main scanning direction that the first recording executes. In the case of the present embodiment, it is possible to treat the second recording as a recording method that uses supercells that are smaller than the supercells H1 and H2 in positions in the main scanning direction that differ from the positions in the main scanning direction that the first recording executes.

In the present embodiment, the term "a supercell being small" refers to a value of at least one of a number of dots (hereinafter, referred to as configuration dot number) that configures a supercell, or a sum (hereinafter, referred to as a sum of lengths) of the lengths of polygonal edges as a supercell being small. The values of both the configuration dot number and the sum of lengths are smaller for the supercells C1 and C2 than for the supercells H1 and H2. Accordingly, the supercells C1 and C2 are smaller than the supercells H1 and H2.

It is possible to treat the recording method of the present embodiment as executing recording so that the second recording is larger than the first recording in a case in which the recording head 90 is positioned in a center in the main scanning direction. Alternatively, it is possible to treat the recording method of the present embodiment as executing recording so that the first recording is larger than the second recording in a case in which the recording head 90 is positioned in an end portion in the main scanning direction. In the present embodiment, in order to realize such a recording method, it is possible to treat a ratio of the first recording to the second recording in a single main scan pass as changing.

Figure 6:
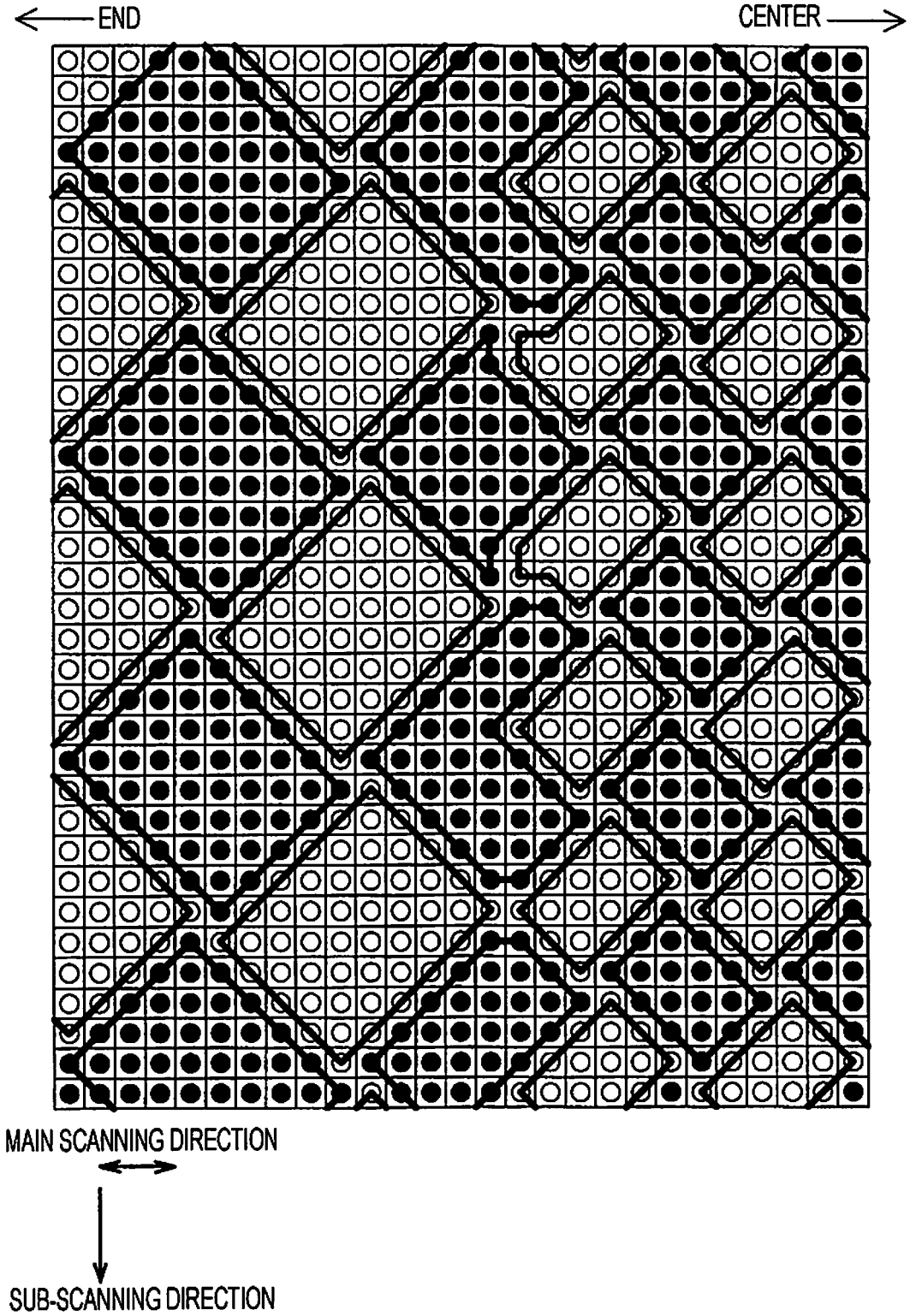
FIG. 6 is a view that shows dot formation in the vicinity of a boundary.
Figure 7:
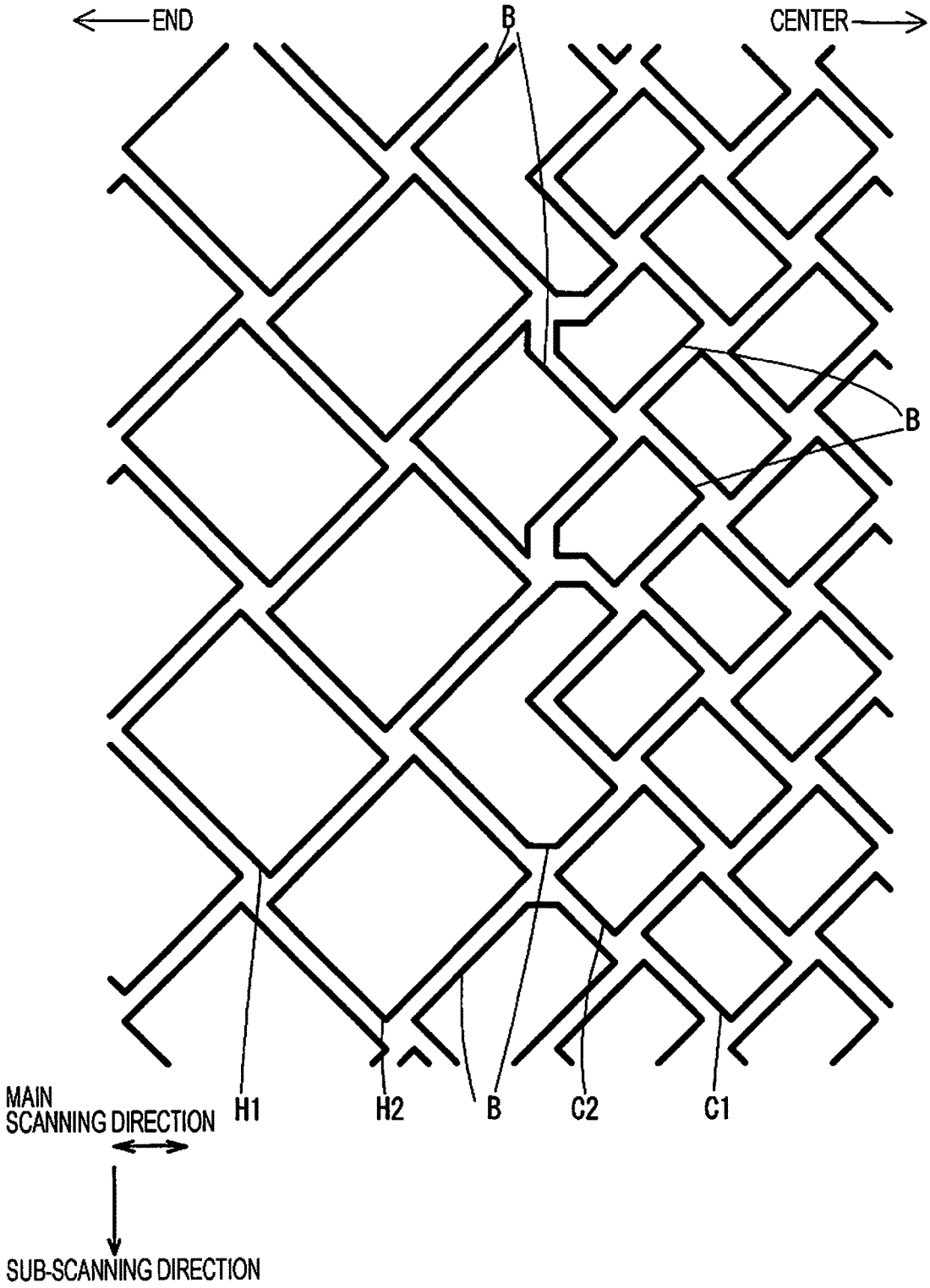
FIG. 7 is a view that shows a boundary line of dot formation.

FIG. 6 shows a state in which dots are formed in a region 6, which is shown in FIG. 3, by an $n+1^{th}$ pass and an $n+2^{th}$ pass. FIG. 7 is a view in which only the boundary lines of the supercells, which are shown in FIG. 6, are shown. The region 6 is a region that includes boundaries in the main scanning direction. In this instance, the term boundary refers to a border line between a region in which the supercells H1 and H2 are used, and a region in which the supercells C1 and C2 are used.

As shown in FIG. 6 and FIG. 7, supercells B are used at the boundaries. The supercells B are supercells for embedding regions that cannot be filled with the supercells H1 and H2 and the supercells C1 and C2. The supercells B can have a number of shapes.

It is preferable that the sizes of the supercells B are an intermediate size between the supercells H1 and H2 and the supercells C1 and C2. The boundary lines of the supercells B in the present embodiment are configured from boundary lines that are not parallel to either the main scanning direction or the sub-scanning direction, and boundary lines that are parallel to either the main scanning direction or the sub-scanning direction.

Figure 8:
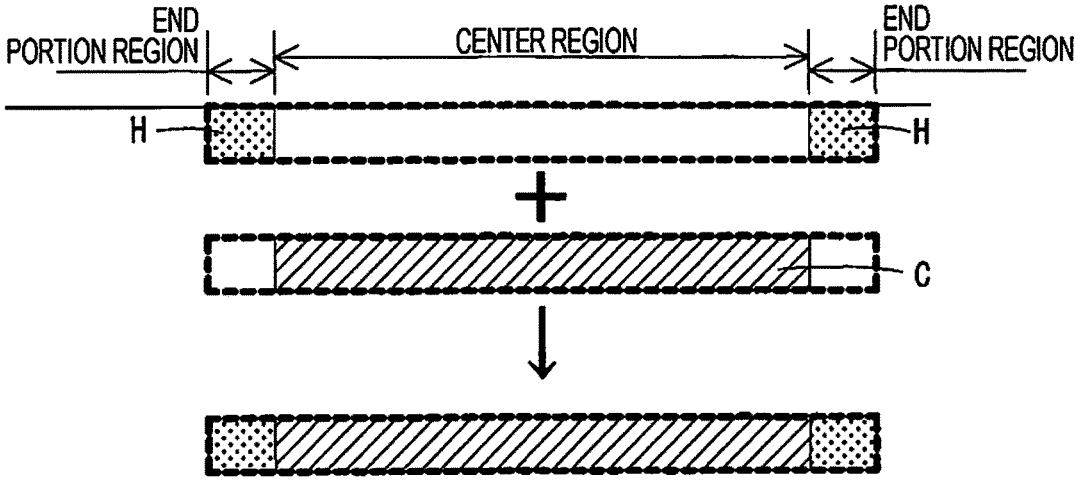
FIG. 8 is a view that shows a mask process in a conceptual manner.

FIG. 8 shows a creation method of raster data, which realizes the disposition of black dots and white dots that is described using FIG. 4 to FIG. 7. A mask H is applied to end portion regions of the dot data that is created by the halftone process, and a mask C is applied to central regions. The mask H is a mask for distributing the black dots and the white dots depending on the supercells H1 and H2. The mask C is a mask for distributing the black dots and the white dots depending on the supercells C1 and C2.

Overall raster data is created by complementing raster data that is distributed by the two types of mask. In the present embodiment, since the supercells B are used, the mask H and the mask C also have a function of creating the supercells B.

According to the embodiment described above, color spotting is suppressed in end portion regions by using the supercells H1 and H2. Furthermore, even if cockling occurs, boundary spotting is suppressed in central regions by using the supercells C1 and C2. In all of the supercells H1, H2, C1 and C2, the boundary lines are not parallel to either the main scanning direction or the sub-scanning direction. As a result of this, boundary spotting is suppressed.

Embodiment 2

Figure 9:
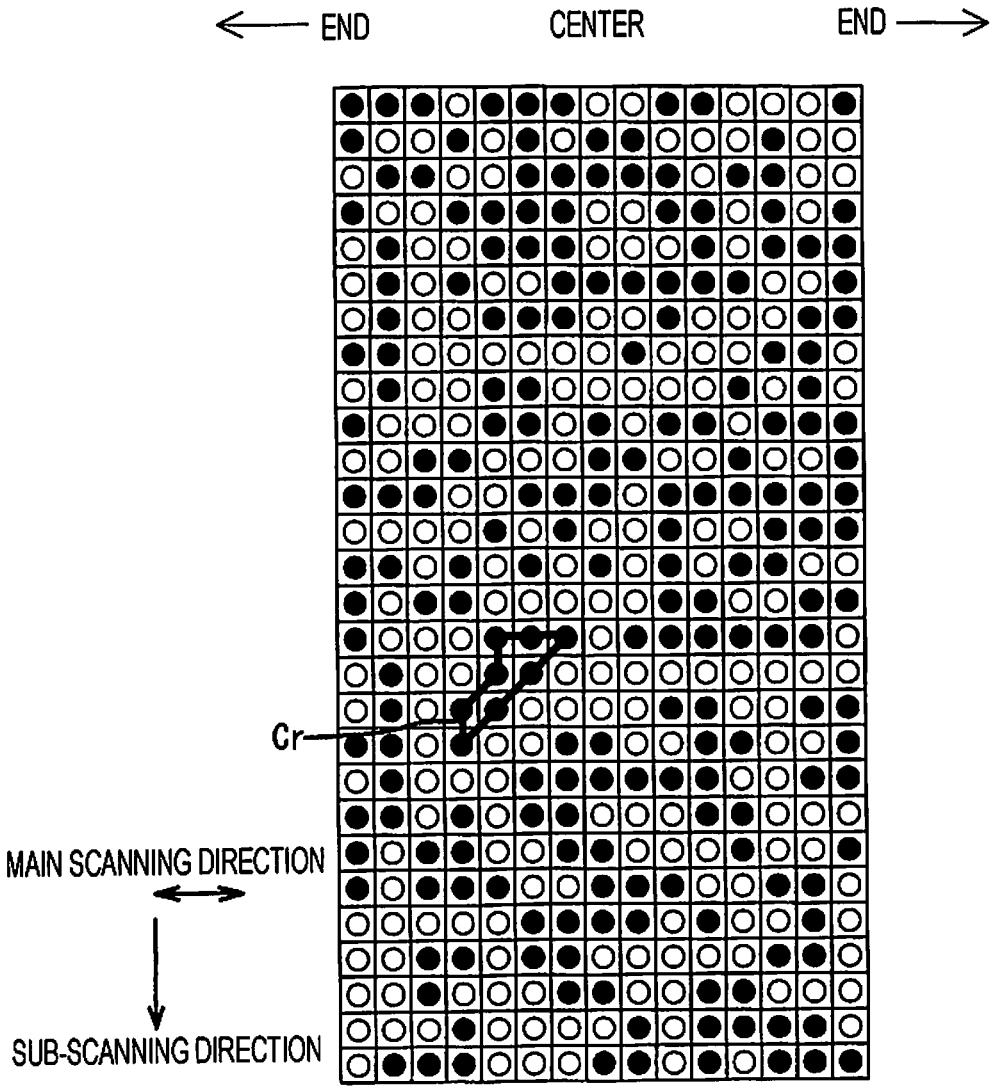
FIG. 9 is a view that shows dot formation in a central region (Embodiment 2).

In Embodiment 2, the first recording in end portion regions is the same as that of Embodiment 1. FIG. 9 shows a state of second recording in a central region. In other words, FIG. 9 shows a state in which dots are formed in a region 5, which is shown in FIG. 3, by an $n+1^{th}$ pass and an $n+2^{th}$ pass. As shown in FIG. 9, black dots and white dots are respectively dispersed. A disposition that disperses in this manner is decided using the mask H.

The mask H in the present embodiment is created using the following method. Firstly, a blue noise mask to be used in the halftone process is prepared. Further, in a case in which the halftone process is carried out on an image in which the gradation value is 50%, a mask H decides so that a pixel in which there are dots is a black dot, and so that a pixel in which there is not an image is a white dot.

In the second recording in Embodiment 2, a multitude of supercells having the same shape is not formed. However, there are cases in which black dots or white dots form supercells as a result of the above-mentioned dispersal. This kind of supercell is illustrated by way of example as a supercell Cr in FIG. 9. The mask C of Embodiment 2 is designed so that there are no supercells that are larger than, or the same size as the supercells H1 and H2.

Figure 10:
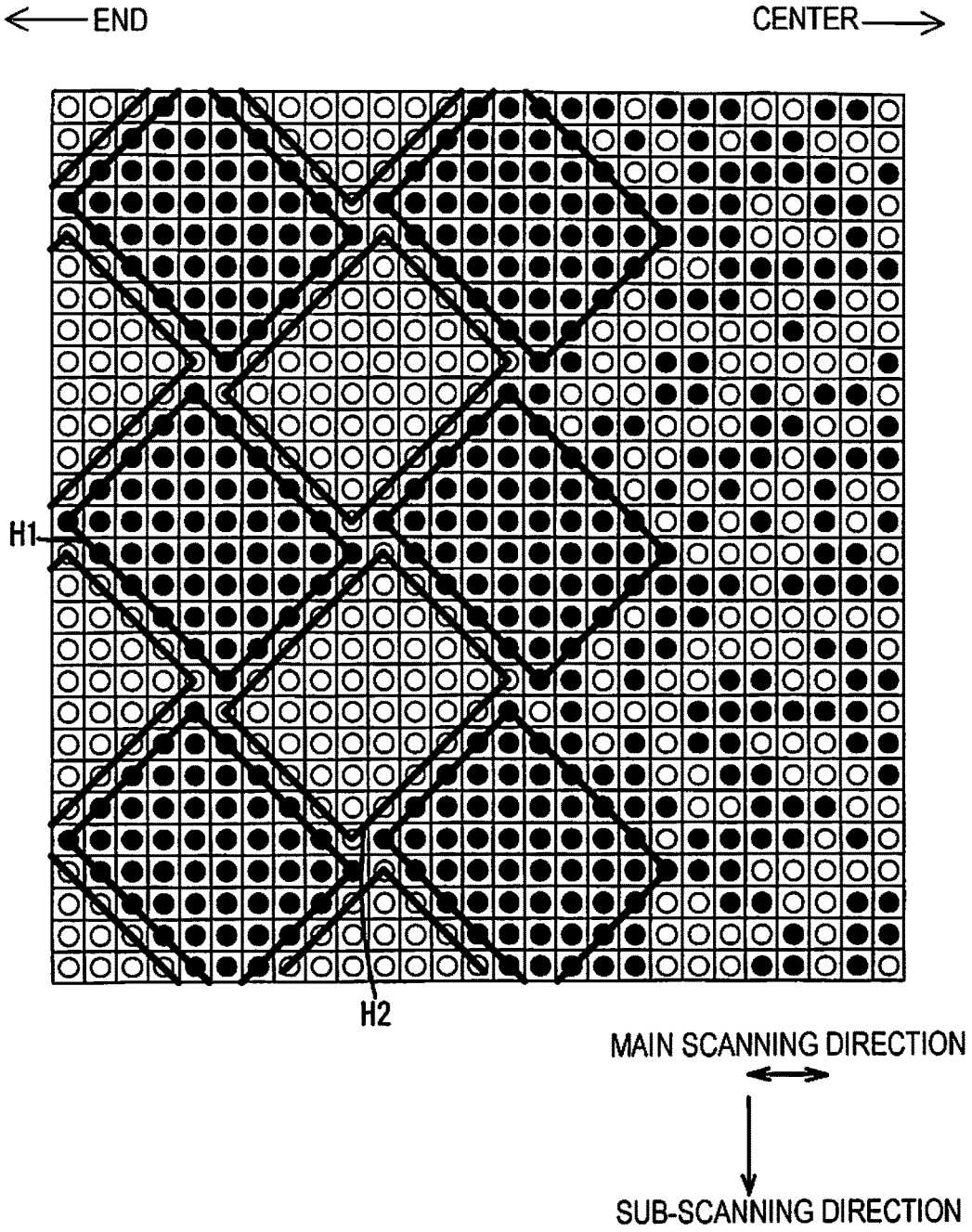
FIG. 10 is a view that shows dot formation in the vicinity of a boundary (Embodiment 2).

FIG. 10 shows a state in which dots are formed in a region 6, which is shown in FIG. 3, by an $n+1^{th}$ pass and an $n+2^{th}$ pass. The region 6 is a region that includes boundaries in the main scanning direction. In this instance, the term boundary refers to a border line between a region in which the supercells H1 and H2 are used, and a region in which black dots and white dots are dispersed. As shown in FIG. 10, in Embodiment 2, the supercells B are not used in the region 6.

According to the present embodiment, boundary spotting is suppressed by the first recording.

Embodiment 3

Figure 11:
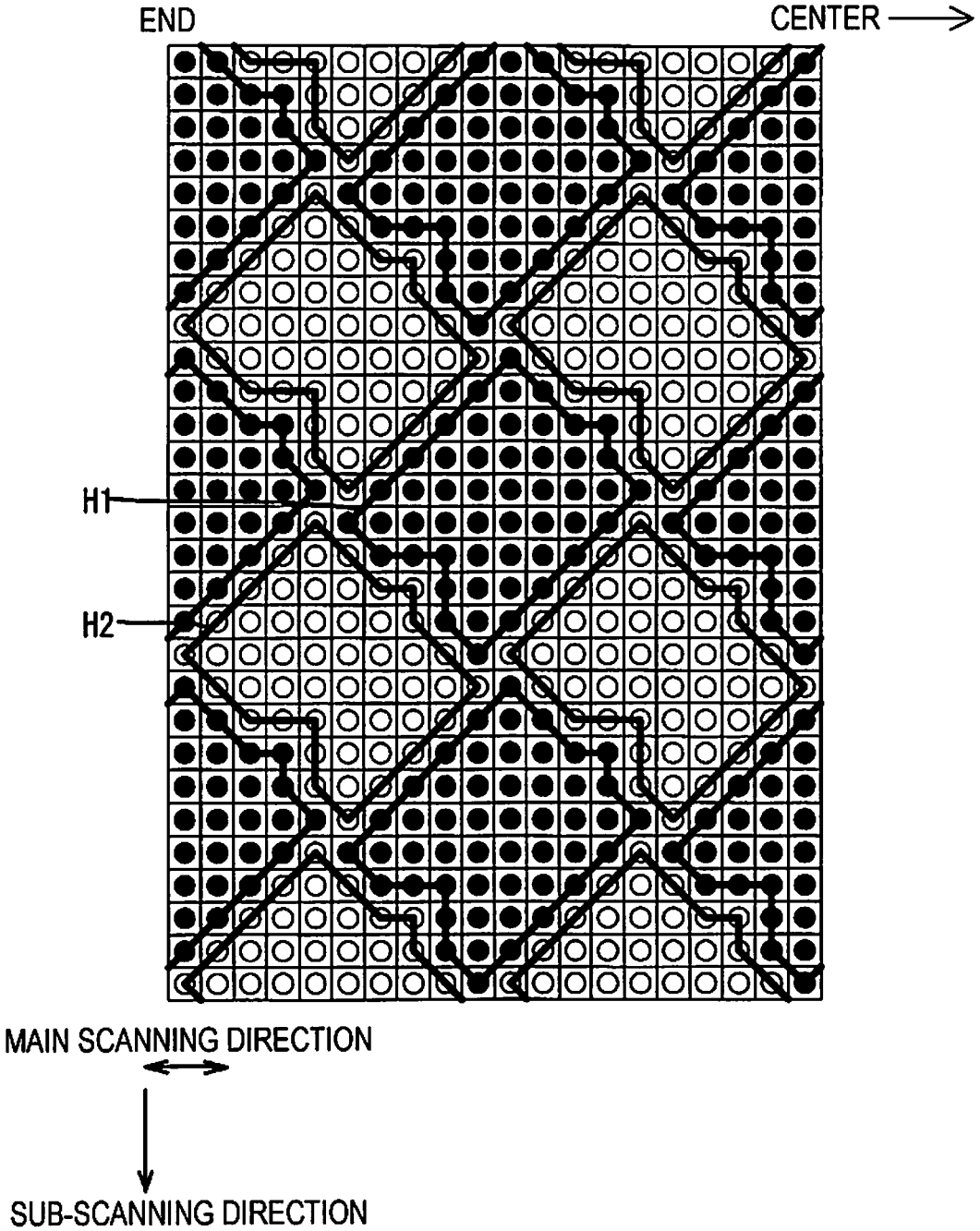
FIG. 11 is a view that shows dot formation in an end portion region (Embodiment 3).
Figure 12:
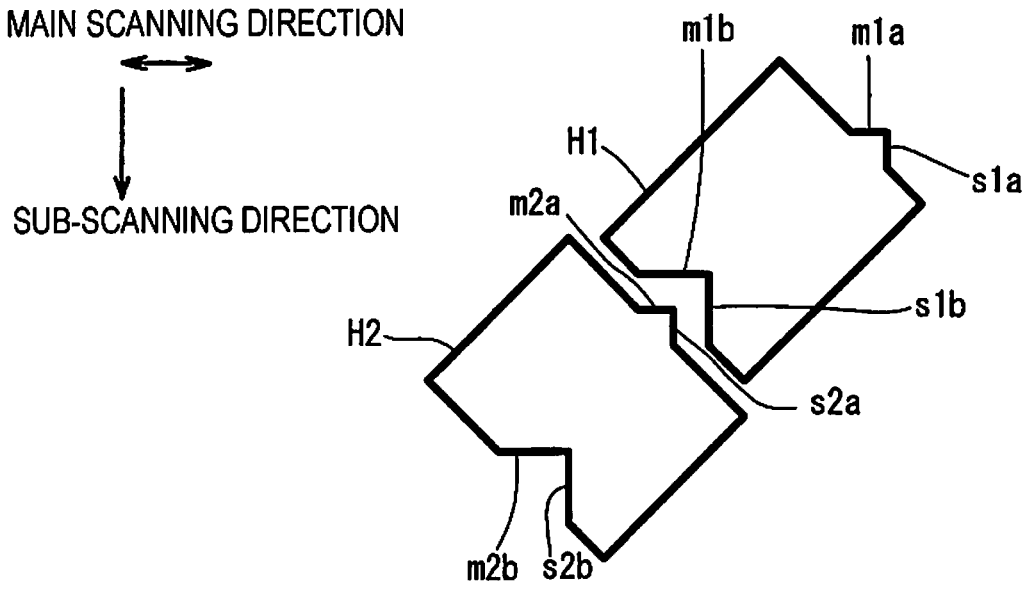
FIG. 12 is a view that shows a boundary line of dot formation in the end portion region (Embodiment 3).

FIG. 11 shows a state of first recording in an end portion region. FIG. 12 is a view that shows boundary lines of a single supercell H1 and a single supercell H2. As shown in FIG. 12, the boundary lines of the supercells H1 and H2 form 10 angles including obtuse angles.

The supercell H1 includes an edge m1*a*, an edge m1*b*, an edge s1*a*, and an edge s1*b*. The edge m1*a* and the edge m1*b* form boundary lines that are parallel to the main scanning direction. As shown in FIG. 11, the edge m1*a* and the edge m1*b* are disposed sparsely. More specifically, the edge m1*a* and the edge m1*b*, which are included in a certain supercell H1, are disposed in positions that are separated from the edges m1*a* and the edges m1*b*, which are included in other supercells H1, and are not disposed continuously.

The edge s1*a* and the edge s1*b* form boundary lines that are parallel to the sub-scanning direction. In the same manner as the edge m1*a* and the edge m1*b*, the edge s1*a* and the edge s1*b* are disposed sparsely. Hereinafter, boundary lines that are parallel to either the main scanning direction or the sub-scanning direction will be referred to as parallel boundary lines.

As shown in FIG. 12, the supercell H2 includes an edge m2*a*, an edge m2*b*, an edge s2*a*, and an edge s2*b*. The edge m2*a* and the edge m2*b* are parallel to the main scanning direction. The edge s2*a* and the edge s2*b* are parallel to the sub-scanning direction. In the same manner as above, the edge m2*a*, the edge m2*b*, the edge s2*a* and the edge s2*b* are disposed sparsely. Additionally, the second recording is the same as that of Embodiment 1.

According to the present embodiment, even if parallel boundary lines are included in the supercells, since the parallel boundary lines are not disposed continuously, it is difficult for boundary spotting to stand out.

Embodiment 4

Figure 13:
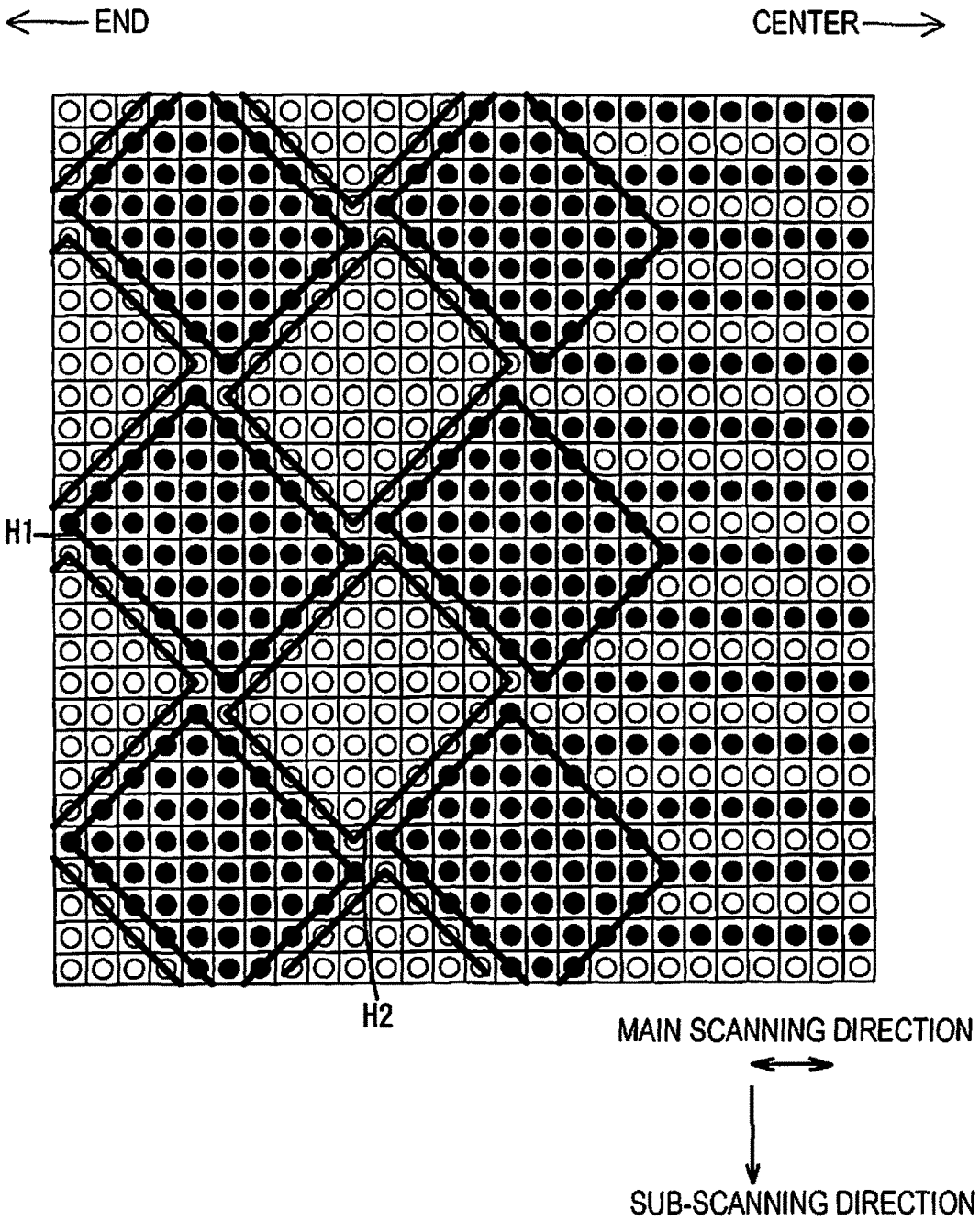
FIG. 13 is a view that shows dot formation in the vicinity of a boundary (Embodiment 4).

FIG. 13 shows a state in which dots are formed in the region 6, which is shown in FIG. 3, in order to describe the first recording and the second recording. As shown in FIG. 13, in the first recording in end portion regions, the supercells H1 and H2 are used in the same manner as the supercells H1 and H2 of Embodiment 1.

On the other hand, in the second recording in central regions, the same dots are aligned in the main scanning direction, and different dots are alternately disposed in the sub-scanning direction. In the same manner as the second recording in the above-mentioned embodiments, it is also possible to treat the second recording in the present embodiment as a recording method that records in a manner that is smaller than the supercells H1 and H2 in positions in the main scanning direction that differ from the positions in the main scanning direction that the first recording executes. In addition, it is possible to treat the second recording as a recording method that avoids the recording of supercells that are larger than the supercells H1 and H2 or of the same size in positions in the main scanning direction that differ from the positions in the main scanning direction that the first recording executes.

Additionally, in the second recording in the present embodiment, dot groups are respectively formed as masses that extend in the main scanning direction for black dots and white dots. However, the dot groups are not supercells. The reason for this is that, in the above-mentioned manner, the supercells in the present specification are dot groups of a mass in which at least a portion of the boundary lines are not parallel to either the main scanning direction or the sub-scanning direction. As shown in FIG. 13, the dot groups of the black dots and the white dots due to the second recording do not satisfy this definition.

According to the present embodiment, it is possible to easily decide the disposition of black dots and white dots in the second recording.

The invention is not limited to the embodiment, examples and modification examples of the present specification, and it is possible to realize various configurations within a range that does not depart from the gist thereof. For example, the technical features of the embodiments, examples and modification examples that correspond to technical features of each aspect that is set forth in the summary columns of the invention, may be replaced, combined, or the like, as appropriate in order to solve a portion of or all of the above-mentioned technical problems, of in order to achieve a portion of or all of the above-mentioned effects. As long as the technical features are not described as essential features in the present specification, it is possible to remove them as appropriate. For example, the following are illustrated by way of example.

One or more supercells may be formed as execution of the first recording. In other words, in a case in which the first recording is executed, dots that do not belong to a supercell may be formed.

The positions in the main scanning direction in which the first recording and the second recording are used may be changed. For example, if a location in which it is easy for cockling to occur, and locations in which it is not easy for cockling to occur differ from those of the embodiment, the first recording and the second recording may be disposed to match those locations.

In addition, both the first recording and the second recording may be used in a certain position in the main scanning direction. For example, large supercells and small supercells may be arranged in the sub-scanning direction in certain positions in the main scanning direction.

A ratio of the first recording and the second recording need not be changed during a single main scan pass. For example, only the first recording may be executed in an $n+1^{th}$ main scan pass, and only the second recording may be executed in an $n+2^{th}$ main scan pass.

The supercells due to the first recording in a single main scan pass need not necessarily have the same shape. The supercells due to the second recording in a single main scan pass need not necessarily have the same shape. The supercells due to the first recording in a plurality of main scan passes may have the same shape. For example, as a method of realizing this, squares may be adopted as the boundary lines of the supercells.

In a case in which a supercell includes parallel boundary lines, the parallel boundary lines, which are included in a certain supercell may be continuous with the parallel boundary lines, which are included in another supercell.

As the second recording, the same dots may be aligned in the sub-scanning direction, and different dots may be alternately disposed in the main scanning direction.

As the second recording, different dots may respectively be alternately disposed in the main scanning direction and the sub-scanning direction.

In a case in which dispersed disposition is adopted as the second recording, dispersal may be performed so that supercells are not formed.

There may be a single recording head, or may be three or more.

For example, the colors of ink may be the four colors of CMYK.

The main scanning direction and the sub-scanning direction need not be orthogonal to one another as long as they intersect.

The image processing unit 20 may be configured integrally with the dot recording unit 60. In addition, the image processing unit 20 may be configured separately from the dot recording unit 60 to be stored in a computer. In this case, the image processing unit 20 may be executed by a CPU as printer driver software (a computer program) on a computer.

The invention can also be applied to various dot recording apparatuses, and for example, can be applied to apparatuses that forms dots by ejecting liquid droplets onto a substrate. Furthermore, the invention may be adopted in liquid ejecting apparatus that eject liquids other than ink, and can be appropriated in various liquid ejecting apparatus that are provided with liquid ejecting heads that eject microscopic amounts of liquid droplets.

Liquid droplets refer to a state of a liquid that is ejected from the above-mentioned liquid ejecting apparatuses, and include a granule form, a tear form, and a filament form that leaves a trail. In addition, the liquid that is referred to in this instance may be any material that a liquid ejecting apparatus can eject. For example, the liquid may be any substance that is in a state in which it is in the liquid phase, and may include liquids in which particles of organic material that are formed from solid matter such as a pigment or metal particles are dissolved, dispersed, or mixed into a solvent in addition to liquid states having high or low viscosities, fluid states such as sols, gel waters, other inorganic solvents, organic solvents, liquid solutions, liquid resins, liquid metals (metallic melts) or substances in a single state. In addition, an ink, liquid crystal or the like such as that described in the abovementioned embodiment can be given as a representative example of the liquid.

In this instance, ink can include various liquid compositions such as a general water-based ink or oil-based ink, a gel ink, or a hot melt ink. As a specific example of a liquid ejecting apparatus, for example, it is possible to use liquid ejecting apparatuses that eject liquids that include materials such as electrode materials and color materials, which are used in the manufacturing of liquid crystal displays, EL (electroluminescence) displays, surface-emitting displays, color filters and the like in a dispersed or dissolved form.

Liquid ejecting apparatuses that eject living organic material that is used in the manufacture of biochips, liquid ejecting apparatuses, textile printing equipment, microdispensers or the like that eject liquids that form specimens that are used as precision pipettes, and the like can also be used. Furthermore, a liquid ejecting apparatus that ejects a lubricating oil with pinpoint precision in a precision instrument such as a watch or a camera, a liquid ejecting apparatus that ejects a transparent resin liquid such as an ultraviolet curable resin for forming a microhemispherical lens (an optical lens) or the like that is used in optical communication elements or the like onto a substrate, or a liquid ejecting apparatus that ejects an etching liquid such as an acid or an alkali for etching a substrate or the like, may also be used.

This application claims priority under 35 U.S.C. § 119 to Japanese Patent Application No. 2015-204361, filed Oct. 16, 2015. The entire disclosure of Japanese Patent Application No. 2015-204361 is hereby incorporated herein by reference.

What is claimed is:

1. A dot recording apparatus comprising:

a main scan driving mechanism that executes a main scan pass, which records dots on a medium while relatively moving a head having a plurality of nozzles, and the medium in a main scanning direction;

a sub-scan driving mechanism that executes a sub-scanning, which relatively moves the medium and the head in a sub-scanning direction, which intersects the main scanning direction; and a control unit that controls the main scan driving mechanism and the sub-scan driving mechanism to execute recording of dots in a common region of the medium using a plurality of main scan passes, wherein the control unit that controls the main scan driving mechanism and the sub-scan driving mechanism to execute a first recording by using ink such that a first supercell is recorded, which is a mass of dot groups in which at least a portion of a boundary line is not parallel to either the main scanning direction or the sub-scanning direction, and the boundary line is defined by line segments that each link edge dots of the mass of the dot groups, the control unit that controls the main scan driving mechanism and the sub-scan driving mechanism to execute a second recording by using the ink such that dots are recorded so as to be smaller than the first supercell, the control unit executes the first recording and the second recording in each of the plurality of main scan passes, the control unit executes the first recording such that in the first recording, a plurality of first supercells which include the first supercell and each of which is the mass of the dot groups are formed, a first group of the first supercells is formed in a first pass of the main scanning passes, a second group of the first supercells is formed in a second pass of the main scanning passes, and a direction of the first pass is opposite that of the second pass.

2. The dot recording apparatus according to claim 1, wherein recording is performed so that the number of executions of the second recording is greater than the number of executions of the first recording in a case in which the head is positioned in a center in the main scanning direction.

3. The dot recording apparatus according to claim 1, wherein recording is performed so that the number of executions of the first recording is greater than the number of executions of the second recording in a case in which the head is positioned at end portions in the main scanning direction.

4. The dot recording apparatus according to claim 1, wherein a ratio of the first recording and the second recording is changed during the main scan passes.

5. The dot recording apparatus according to claim 1, wherein, recording is executed using a disposition in which dots are dispersed as the second recording.

6. The dot recording apparatus according to claim 1, wherein, the control unit controls the main scan driving mechanism and the sub-scan driving mechanism to execute the second recording such that second supercells each of which is smaller than the first supercell are recorded.

7. The dot recording apparatus according to claim 1, wherein, a plurality of the first supercells are recorded as the first recording, and wherein the boundary lines of the plurality of the first supercells have the same polygonal shape.

8. The dot recording apparatus according to claim 1, wherein the first supercells include parallel boundary lines, which are boundary lines that are parallel to either the main scanning direction or the sub-scanning direction, and wherein the parallel boundary line that is included in a given supercell is formed in a position that is separated from the parallel boundary line that is included in another supercell.

9. A production method of dot recorded matter using a main scan driving mechanism that executes a main scan pass, which records dots on a medium while relatively moving a head having a plurality of nozzles, and the medium in a main scanning direction, and a sub-scan driving mechanism that executes a sub-scanning, which relatively moves the medium and the head in a sub-scanning direction, which intersects the main scanning direction, the method comprising:

executing recording of dots in a common region of the medium using a plurality of main scan passes, the executing including executing, a first recording y using ink such that a supercell is recorded, which is a mass of dot groups in which at least a portion of a boundary line is not parallel to either the main scanning direction or the sub-scanning direction, the boundary line being defined by line segments that each link edge dots of the mass of the dot groups, executing a second recording by using the ink such that dots are recorded so as to be smaller than the supercell, and executing the first recording and the second recording in each of the plurality of main scan passes, the executing of the first recording including executing the first recording such that in the first recording, a plurality of supercells which include the supercell and each of which is the mass of the dot groups are formed, a first group of the supercells is formed in a first pass of the main scanning passes, a second group of the supercells is formed in a second pass of the main scanning passes, and a direction of the first pass is opposite that of the second pass.

10. A non-transitory computer-readable medium storing computer program that causes a computer to execute creating data that respectively indicates presence or absence of dot recording in each position in a main scanning direction for a plurality of nozzles in order for a control unit, which controls a main scan driving mechanism that executes a main scan pass, which records dots on a medium while relatively moving a head having a plurality of nozzles, and the medium in a main scanning direction, and a sub-scan driving mechanism that executes a sub-scanning, which relatively moves the medium and the head in a sub-scanning direction, which intersects the main scanning direction, to execute recording of dots in a common region of the medium using a plurality of main scan passes, the creating of the data including creating, in each of the plurality of main scan passes, data for executing a first recording by using ink such that a supercell is recorded, which is a mass of dot groups in which at least a portion of a boundary line is not parallel to either the main scanning direction or the sub-scanning direction, the boundary line being defined by line segments that each link edge dots of the mass of the dot groups, executing a second recording by using the ink such that dots are recorded so as to be smaller than the supercell, and executing the first recording and the second recording in each of the plurality of main scan passes, the executing of the first recording including executing the first recording such that in the first recording, a plurality of supercells which include the supercell and each of which is the mass of the dot groups are formed, a first group of the supercells is formed in a first pass of the main scanning passes, a second group of the supercells is formed in a second pass of the main scanning passes, and a direction of the first pass is opposite that of the second pass.

* * * * *